US006722911B2

(12) United States Patent
Ye

(10) Patent No.: US 6,722,911 B2
(45) Date of Patent: Apr. 20, 2004

(54) SOCKET CONNECTOR WITH RELIABLE COVER AND BASE CONFIGURATION

(75) Inventor: Hui Ye, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/266,358

(22) Filed: Oct. 7, 2002

(65) Prior Publication Data

US 2003/0129859 A1 Jul. 10, 2003

(30) Foreign Application Priority Data

Jan. 18, 2002 (TW) ..... 91200435 U

(51) Int. Cl.[7] ..... H01R 13/625; H01R 4/50
(52) U.S. Cl. ..... 439/342; 439/264; 439/268
(58) Field of Search ..... 439/264, 266, 439/268, 259

(56) References Cited

U.S. PATENT DOCUMENTS 5,044,967 A * 9/1991 Takano ..... 439/79
5,336,099 A * 8/1994 Aldous et al. ..... 439/131

* cited by examiner

*Primary Examiner*—Hae Moon Hyeon
(74) *Attorney, Agent, or Firm*—Wei Te Chung

(57) ABSTRACT

An electrical connector for electrically connecting an electronic package such as a central processing unit with a circuit substrate such as a printed circuit board. The electrical connector includes an insulative base (1), and a cover (2) slidably attached on the base. The cover includes a pair of opposite retention flanges (22). A pair of sliding slots (222) is defined in the flanges, and a pair of locating recesses (221) is defined in the flanges respectively adjacent the sliding slots. The base includes a pair of opposite sliding rails (1222), and a pair of locating protrusions (1221) formed respectively adjacent the sliding rails. When the cover is attached to the base, the sliding slots guide and receive the sliding rails therein, and the locating recesses retainingly receive the locating protrusions therein.

19 Claims, 3 Drawing Sheets

SOCKET CONNECTOR WITH RELIABLE COVER AND BASE CONFIGURATION

BACKGROUND OF THE INVENTION

1. Field of the Invention

The present invention relates to an electrical connector for electrically connecting an electronic package such as a central processing unit (CPU) with a circuit substrate such as a printed circuit board (PCB), and particularly to a CPU socket with a cover and base that-facilitates safe and reliable assembly of the cover and the base.

2. Description of the Prior Art

CPU sockets axe widely used in personal computer (PC) systems to electrically connect CPUs with PCBs. Referring to FIG. 3, a conventional CPU socket 5 comprises a base 51, and a cover 52 slidably engaged on the base 51. Typically, the base 51 comprises two tabs 511 formed on each of two opposite aide walls (not labeled) thereof. The cover 52 comprises a supporting plate 521 for supporting the CPU when the CPU is electrically connected with the CPU socket 5. Two retention flanges 522 extend perpendicularly from opposite lateral sides of the supporting plate 521, for fittingly receiving the two side walls of the base 51 therebetween. Two slots 5221 are defined in each retention flange 522, for retainingly receiving the corresponding tabs 511 therein when the cover 52 is pressed onto the base 51. Thus, the retention flanges 522 abut the side walls of the base 51, and the cover 52 is attached to the base 51.

However, because the cover 52 is pressed onto the base 51 in a vertical direction, the tabs 511 outwardly deform the retention flanges 522 before the tabs 511 are received in the slots 5221. Occasionally, such deformation of the retention flanges 522 results in unduly loose engagement between the cover 52 and the base 51. When this happens, the cover 52 may not slide properly or may fail to slide altogether. Furthermore, damage to the whole CPU socket 5 may result.

In view of the above, a new CPU socket that overcomes the above-mentioned disadvantages is desired.

SUMMARY OF THE INVENTION

Accordingly, an object of the present invention is to provide an electrical connector for electrically connecting an electronic package such as a CPU with a circuit substrate such as a PCB, whereby the electrical connector can prevent undue deformation of a cover thereof.

To achieve the above-mentioned object, an electrical connector in accordance with a preferred embodiment of the present invention includes an insulative base and a cover slidably attached on the base. The cover includes a pair of opposite retention flanges. A pair of sliding slots is defined in the flanges, and a pair of locating recesses is defined in the flanges respectively adjacent the sliding slots. The base includes a pair of opposite sliding rails, and a pair of locating protrusions formed respectively adjacent the sliding rails. When the cover is attached to the base, the sliding slots guide and receive the sliding rails therein, and the locating recesses retainingly receive the locating protrusions therein.

Other objects, advantages and novel features of the invention will become more apparent from the following detailed description when taken in conjunction with the accompanying drawings, in which:

DETAILED DESCRIPTION OF PREFERRED EMBODIMENT OF THE INVENTION

Reference will now be made to the drawings to describe the present invention in detail.

Figure 1:
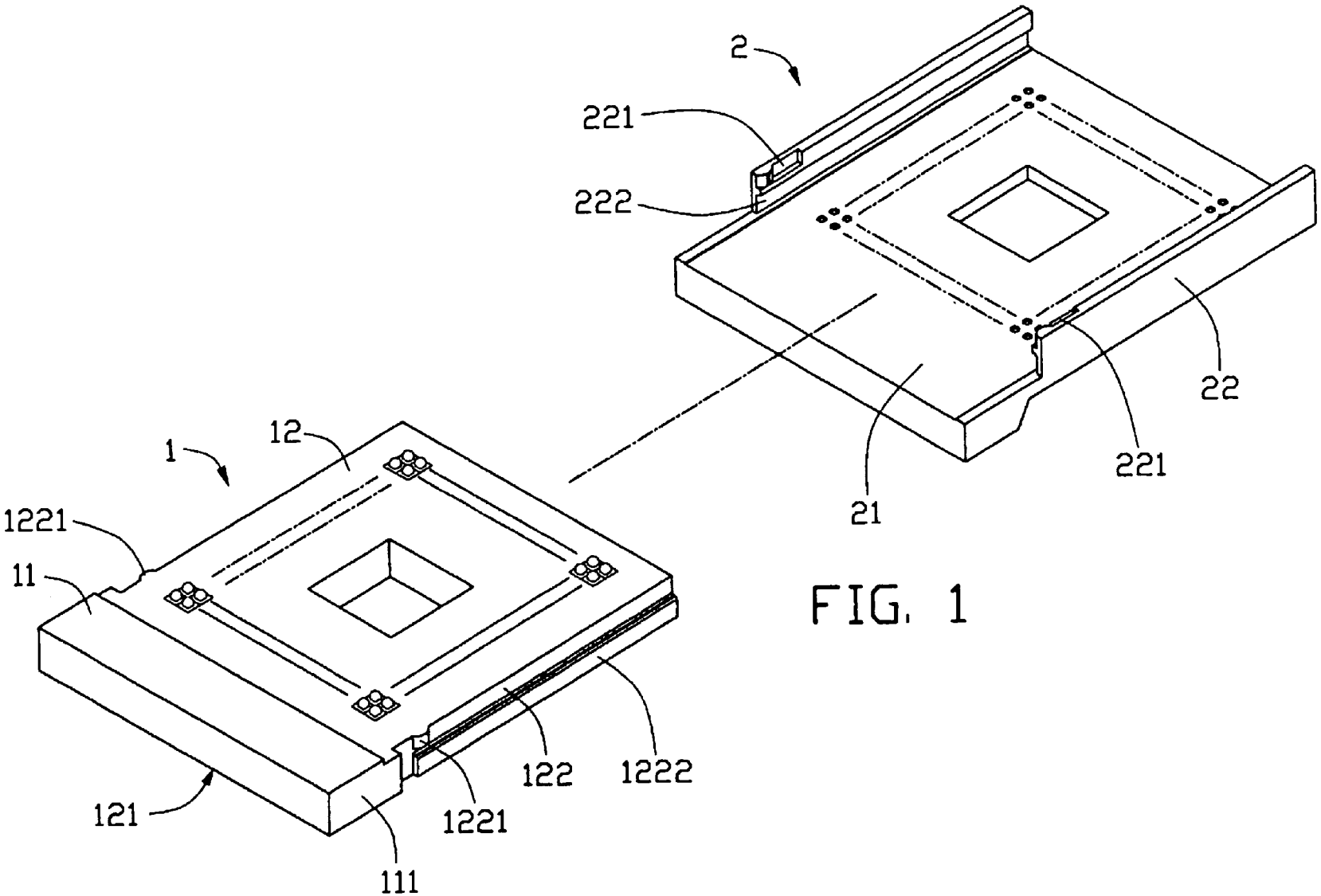
FIG. 1 is an exploded, isometric view of a CPU socket in accordance with the preferred embodiment of the present invention, viewed from a bottom aspect and simplified for clarity.

Referring to FIG. 1, a CPU socket in accordance with the preferred embodiment of the present invention comprises a base 1 and a cover 2. The base 1 comprises a mating plate 12, and a head portion 11 disposed at one end of the mating plate 12. The base 1 further comprises a bottom mating face 121. A multiplicity of terminals (not labeled) is accommodated in the base 1, for mating with pins of a CPU (not shown). The head portion 11 has a pair of first side walls 111 at opposite lateral sides thereof respectively. The mating plate 12 has a pair of second side walls 122 at opposite lateral sides thereof respectively. A distance between the first side walls 111 is greater than a distance between the second aide walls 122. A pair of horizontal sliding rails 1222 is formed on lower portions of the second side walls 122 respectively. A pair of locating protrusions 1221 is formed on upper portions of the second side walls 122 respectively. The locating protrusions 1221 are disposed at ends of the corresponding sliding rails 1222 that are nearest the head portion 11.

The cover 2 comprises a supporting plate 21 for covering the mating face 121 of the base 1, and a pair of retention flanges 22 extending perpendicularly from opposite lateral sides of the supporting plate 21 respectively. Each retention flange 22 defines a horizontal sliding slot 222 in an inner face thereof, for receiving and guiding a corresponding sliding rail 1222 of the base 1. A locating recess 221 is defined near an end of the inner face of each retention flange 22 adjacent the corresponding sliding slot 222, for accommodating a corresponding locating protrusion 1221 of the base 1 therein.

Figure 2:
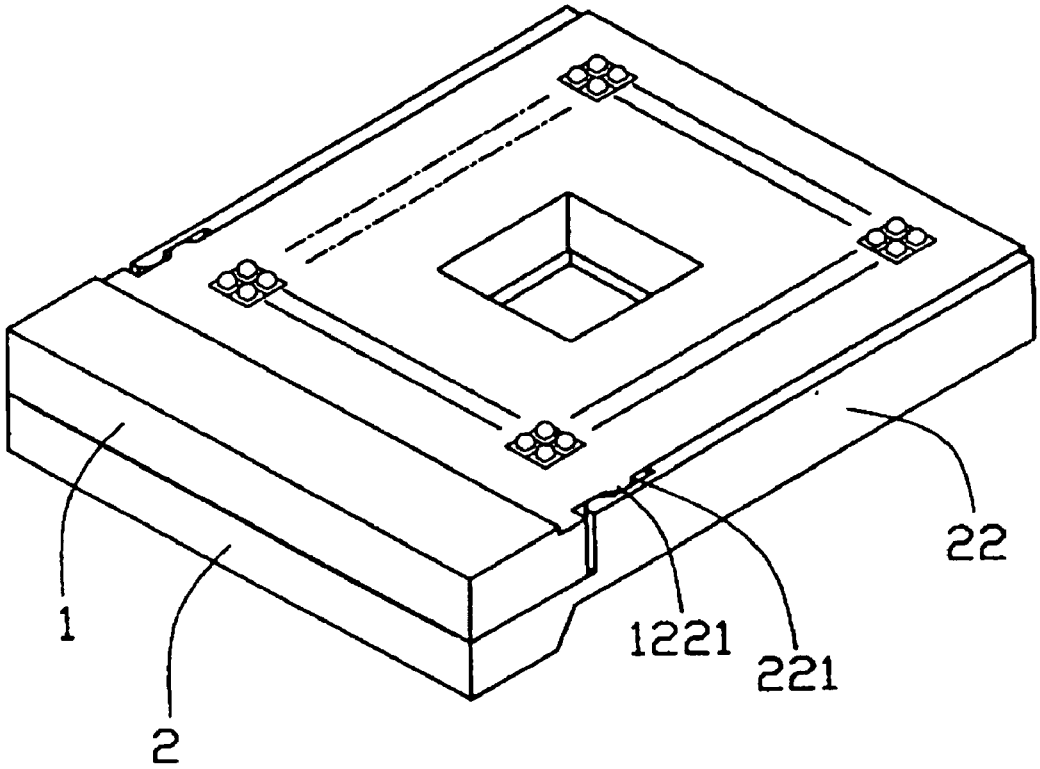
FIG. 2 is an assembled view of FIG. 1.
Figure 3:
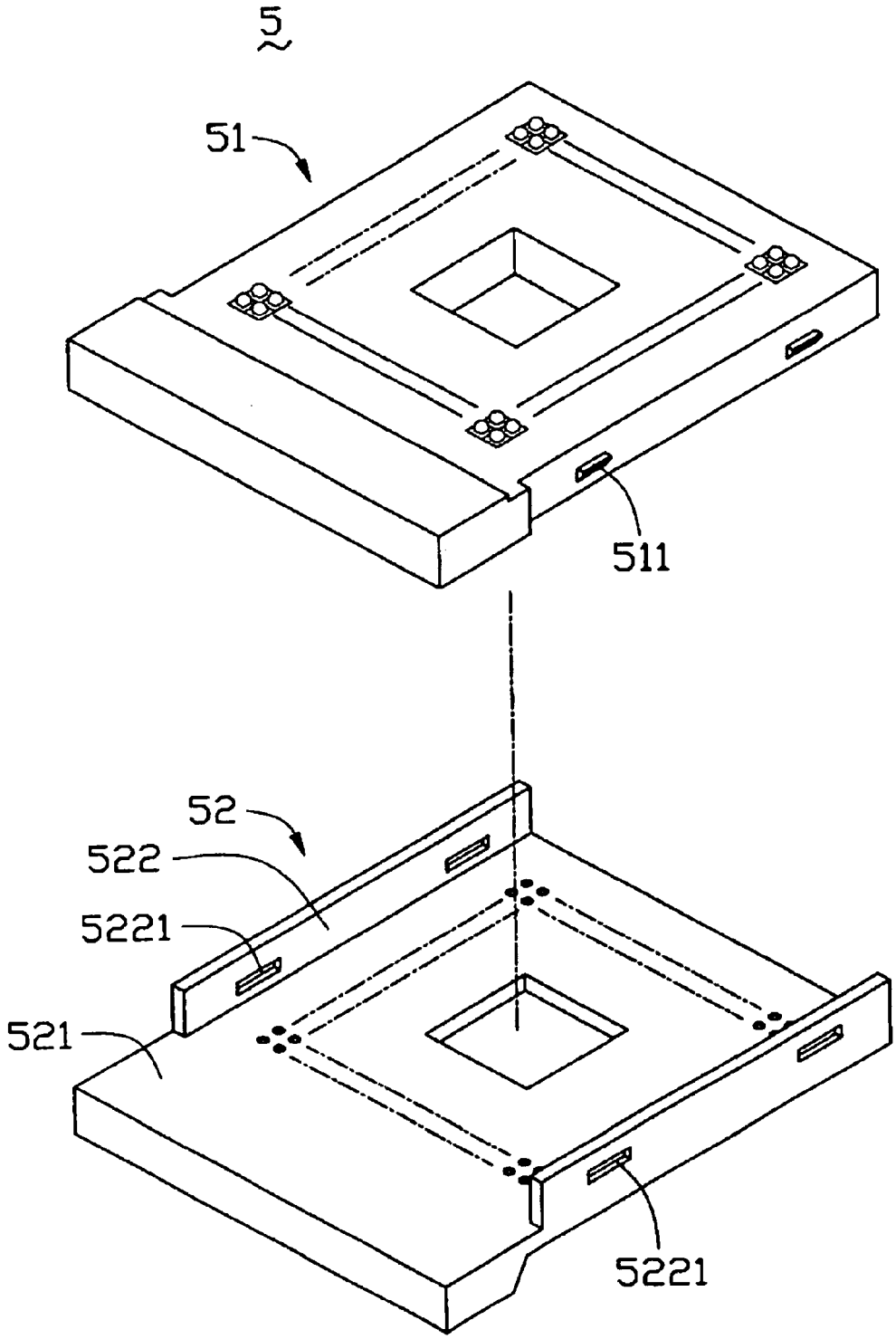
FIG. 3 (PRIOR ART)
FIG. 3 is an exploded, isometric view of a conventional CPU socket, viewed from a bottom aspect and simplified for clarity.

Referring also to FIG. 2, in assembly, the cover 2 is attached on the base 1. The sliding rails 1222 are slid along the sliding slots 222. The locating protrusions 1221 slightly deflect the retention flanges 22 outwardly, and are snappingly received in the locating recesses 221. The sliding rails 1222 cooperate with the sliding slots 222 to prevent separation between the cover 2 and the base 1 in directions perpendicular to the mating face 121. The locating protrusions 1221 cooperate with the locating recesses 221 to prevent separation between the cover 2 and the base 1 in longitudinal directions.

Each locating protrusion 1221 has a smooth arcuate surface. The locating protrusions 1221 can therefore be received in the locating recesses 221 without scraping or damaging the retention flanges 22. Accordingly, the cover 2 can be easily attached and held to the base 1, and the risk of damage to the retention flanges 22 is effectively minimized.

One feature of the invention is to have the base and the cover fastened to each other by assembling at least along a horizontal direction in a drawer type horizontal assembling way instead of the traditional single vertical assembling way. Understandably, the assembling way of the invention may be further varied to be a hybrid type, i.e., the horizontal drawer type plus the vertical type, if some portions of the sliding rail and the sliding slot form some openings in the vertical direction to have the cover able to be assembled to the base first in the vertical direction within a specific small range and successively move in the horizontal direction until fully assembled. Anyhow, in the current embodiment, the sliding rail and the sliding slot are both substantially of the complete size along the horizontal direction thereby more efficiently and reliably assuring precise assembling between the cover and the base in the vertical direction. In comparison, in the prior art the vertical engagement between the cover and the base is separated to be within several ranges instead of a whole complete vertical engagement therebetween along the front-to-back horizontal direction as shown in the instant embodiment of the invention. On the other hand, via modifications, there might be more than one locating protrusion and corresponding recess in the base and the cover along the horizontal direction, if necessary.

While a preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector for electrically connecting an electronic package with a circuit substrate, the electrical connector comprising:

a cover supporting the electronic package thereon, the cover defining a sliding slot and a locating recess adjacent the sliding slot;

a base attached to the cover and mounted on the circuit substrate, the base comprising a sliding rail and a locating protrusion formed adjacent the sliding rail; and a plurality of terminals accommodated in the base;

wherein the sliding slot guides and receives the sliding rail therein and the locating recess retainingly receives the locating protrusion therein when the cover is attached to the base.

2. The electrical connector as claimed in claim 1, wherein the cover comprise a supporting plate, and a pair of retention flanges perpendicularly arranged at opposite lateral sides of the supporting plate.

3. The electrical connector as claimed in claim 2, wherein the sliding slot and the locating recess are defined in one of the retention flanges.

4. The electrical connector as claimed in claim 1, wherein the base comprises a mating plate, and two opposite side walls at opposite lateral sides of the mating plate.

5. The electrical connector as claimed in claim 4, wherein the sliding rail and the locating protrusion are arranged on one of the side walls.

6. The electrical connector as claimed in claim 1, wherein the locating protrusion is snappingly received in the locating recess along a longitudinal direction of the electrical connector.

7. The electrical connector as claimed in claim 6, wherein the locating protrusion has a smooth arcuate surface.

8. An electrical connector for electrically connecting a central processing unit (CPU) with a printed circuit board (PCB), the electrical connector comprising:

a cover comprising a sliding slot defined in a lateral side thereof; and a base comprising a sliding rail arranged on a lateral side thereof and received in the sliding slot of the cover, the base accommodating a plurality of terminals for electrically connecting with the CPU;

wherein the cover and the base complementarily comprise at least one retention protrusion and at least one retention recess receiving the at least one retention protrusion, the engagement of the at least one retention protrusion in the at least one retention recess preventing unwanted separation of the cover from the base along a direction corresponding to the sliding rail.

9. The electrical connector as claimed in claim 8, wherein the cover comprises a supporting plate, and a pair of retention flanges perpendicularly arranged at opposite lateral sides of the supporting plate.

10. The electrical connector as claimed in claim 9, wherein the sliding slot and the at least one retention recess are defined in at least one of the retention flanges.

11. The electrical connector as claimed in claim 10, wherein the base comprises a mating plate, and two opposite side walls at opposite lateral sides of the mating plate.

12. The electrical connector as claimed in claim 11, wherein the sliding rail and the at least one retention protrusion are arranged on at least one of the side walls.

13. The electrical connector as claimed in claim 9, wherein the at least one retention protrusion is formed on at least one of the retention flanges.

14. The electrical connector as claimed in claim 13, wherein the at least one retention protrusion has a smooth arcuate surface.

15. The electrical connector as claimed in claim 14, wherein the base comprises a mating plate, and two opposite side walls at opposite lateral sides of the mating plate, and the at least one retention recess is defined in at least one of the side walls.

16. An electrical connector comprising:

a stationary base;

a plurality of terminals accommodated in the base;

a cover slidably mounted on the base and moveably along a front-to-back direction thereof;

a horizontal sliding slot extending along a lateral side of one of said base and said cover along said front-to-back direction;

a horizontal sliding rail extending along a lateral side of the other of the base and the cover along said front-to-back direction corresponding to and compliant with said sliding rail in both size and position so as to provide a reliable securement between the cover and the base in a vertical direction;

at least one interengaging device formed on both said base and said cover so as to allow said cover to be assembled to the cover along at least the from-to-back direction in an easy and smooth manner until at an end period of assembling under a condition that said interengaging device prevents the cover from being withdrawn from the base in a direction opposite to said front-to-back direction after the cover and the base are fully assembled together in said front-to-back direction.

17. The electrical connector as claimed in claim 16, wherein said interengaging device includes a locating protrusion positioned around a rear portion of the base, and a recess positioned around a rear portion of the cover.

18. The electrical connector as claimed in claim 16, wherein said sliding rail and said sliding slot extend completely along the front-to-back direction without interruption.

19. The electrical connector as claimed in claim 16, wherein said sliding slot is positioned in the cover and said sliding rail is located on the base.

* * * * *